US006663725B2

(12) United States Patent
Inoue et al.

(10) Patent No.: US 6,663,725 B2
(45) Date of Patent: Dec. 16, 2003

(54) HIGH STRENGTH STEEL SHEET AND METHOD FOR MANUFACTURING THE SAME

(75) Inventors: Tadashi Inoue, Fukuyama (JP); Hiroyasu Kikuchi, Fukuyama (JP); Sadanori Imada, Fukuyama (JP); Takayuki Odake, Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/827,597

(22) Filed: Apr. 5, 2001

(65) Prior Publication Data

US 2002/0000266 A1 Jan. 3, 2002

Related U.S. Application Data

(63) Continuation of application No. PCT/JP00/06252, filed on Sep. 13, 2000.

(30) Foreign Application Priority Data

| | | |
|---|---|---|
| Sep. 16, 1999 | (JP) | 11-261418 |
| Mar. 17, 2000 | (JP) | 2000-075482 |
| Jun. 26, 2000 | (JP) | 2000-191410 |
| Jul. 17, 2000 | (JP) | 2000-216316 |
| Aug. 29, 2000 | (JP) | 2000-259595 |

(51) Int. Cl.[7] ..... C22C 38/40; C22C 38/18; C21D 8/00

(52) U.S. Cl. ..... 148/320; 148/333; 148/334; 148/541; 148/547; 148/654; 148/661; 148/602

(56) References Cited

FOREIGN PATENT DOCUMENTS

| | | | |
|---|---|---|---|
| JP | 61-15929 B | 4/1986 | |
| JP | 63-67524 B | 12/1988 | |
| JP | 3-17244 A | 1/1991 | |
| JP | 4-88125 A | 3/1992 | |
| JP | 406336637 A | * 12/1994 | ..... C22C/38/00 |
| JP | 7-54051 A | 2/1995 | |
| JP | 7-56053 B | 6/1995 | |
| JP | 2555436 B | 9/1996 | |

OTHER PUBLICATIONS

U.S. patent application Ser. No. 09/821,609, Inoue et al., filed Mar. 29, 2001.

U.S. patent application Ser. No. 09/837,435, Inoue et al., filed Apr. 18, 2001.

U.S. patent application Ser. No. 09/838,017, Inoue et al., filed Apr. 19, 2001.

U.S. patent application Ser. No. 09/864,473, Nakata et al ., filed May 24, 2001.

* cited by examiner

*Primary Examiner*—Deborah Yee
(74) *Attorney, Agent, or Firm*—Frishauf, Holtz, Goodman & Chick, P.C.

(57) ABSTRACT

The present invention relates to a high strength steel sheet consisting essentially of 0.04 to 0.1% C, 0.5% or less Si, 0.5 to 2% Mn, 0.05% or less P, 0.005% or less 0, 0.005% or less S, by weight, having 10 $\mu$m or less of average ferritic grain size, and 20 mm/mm$^2$ or less of generation frequency A, which generation frequency A is defined as the total length of a banded secondary phase structure observed per 1 mm$^2$ of steel sheet cross section along the rolling direction thereof. The steel sheet is manufactured by, for example, a method comprising the steps of: hot-rolling a continuously cast slab having the composition described above at temperatures of $Ar_3$ transformation point or above directly or after reheating thereof; and cooling the hot-rolled steel sheet within 2 seconds down to the temperatures of from 600 to 750° C. at cooling speeds of from 100 to 2,000° C./sec, followed by coiling the cooled steel sheet at temperatures of from 450 to 650° C. The present invention provides a high strength steel sheet having strengths of 340 MPa or more and having excellent stretch flanging performance, ductility, and shock resistance, providing a sufficient coil shape with good surface properties, even when hot dip zinc-coating is applied.

16 Claims, 6 Drawing Sheets

HIGH STRENGTH STEEL SHEET AND METHOD FOR MANUFACTURING THE SAME

This application is a continuation application of International Application PCT/JP00/06252 (not published in English) filed Sep. 13, 2000.

BACKGROUND OF THE INVENTION

1. Field of the Invention

The present invention relates to a high strength steel sheet having 340 MPa or higher strength and giving excellent stretch flanging performance, ductility, shock resistance, surface properties, and other characteristics, and relates to a method for manufacturing the same.

2. Description of Related Art

Steel sheets such as hot-rolled steel sheets and cold-rolled steel sheets are press-worked in various shape members for use in the fields of automobiles, household electric appliances, industrial machines, and the like. In recent years, manufacturers of automobiles and other products have increased their use rate of high strength steel sheets responding to the need of weight reduction.

The high strength steel sheets have, however, problems such as the stretch flanging cracks occurred when the high strength steel sheets having 340 MPa or higher strength are treated by burring, the workability issue such as insufficient ductility of high strength hot dip zinc-coated steel sheets having 440 MPa or higher strength, and the issue of insufficient shock resistance which is important to secure safety on collision. Those types of high strength steel sheets having 340 MPa or higher strength are manufactured using the base carbon steel being adjusted in carbon equivalent to 0.05 to 0.2 wt. % C, adding precipitation-strengthening elements such as Ti, Nb, and V responding to the strength thereof. When, however, the steels of these compositions are hot-rolled, cracks likely occur, which degrades the surface properties to significantly reduce the production yield.

As the technologies for improving the workability of high strength steel sheets, JP-B-61-15929 and JP-B-63-67524, (the term "JP-B" referred herein signifies "Examined Japanese Patent Publication"), for example, disclose the method to improve the balance of strength and ductility, the breaking elongation (ductility), and the toughness by controlling the cooling speed after hot-rolling and the coiling temperature. As the technology to improve the stretch flanging performance, Japanese Patent No. 2555436 discloses the method for manufacturing steel sheet having strengths of from 500 to 600 MPa and having excellent stretch flanging performance, which steel sheet is prepared by hot-rolling a Ti-added steel, by cooling the steel sheet at cooling speeds of from 30 to 150° C./sec, and by coiling the steel sheet at temperatures of from 250 to 540° C. to establish a (ferrite +bainite) structure. JP-B-7-56053 discloses the method for manufacturing hot dip zinc-coated steel sheet having strengths of from 450 to 500 MPa and having excellent stretch flanging performance, which steel sheet is prepared by cooling a hot-rolled steel sheet at cooling speeds of 10° C./sec or more to establish a (ferrite+pearlite) structure. JP-A-4-88125, (the term "JP-A" referred herein signifies "Unexamined Japanese Patent Publication"), discloses the method for manufacturing steel sheet having strengths of from 500 to 700 MPa and having excellent stretch flanging performance, which steel sheet is prepared by hot-rolling a Ca-added steel at temperatures of from ($Ar_3$ transformation point+60° C.) to 950° C., by cooling the steel sheet within 3 seconds after completed the hot-rolling down to the temperature range of from 410 to 620° C. at cooling speeds of 50° C./sec or more, by cooling the steel sheet in air, and by coiling the steel sheet at temperatures of from 350 to 500° C. to establish a (ferrite+pearlite) structure. JP-A-7-54051 discloses the method for manufacturing high strength hot dip zinc-coated steel sheet having excellent stretch flanging performance and ductility, which steel sheet is prepared by hot-rolling a Nb—Ti added steel at temperatures ranging from 850 to 1,000° C., by cooling the hot-rolled steel sheet down to 600° C. at average cooling speeds of 40° C./sec or more, by further cooling the steel sheet at average cooling speeds of 30° C./sec or less, by coiling the steel sheet at temperatures of from 400 to 550° C., and by applying hot dip zinc-coating.

The methods described in these prior arts, however, have problems of unable to completely prevent the stretch flanging cracks occurred during burring treatment, of not necessarily unable to assure excellent shock resistance, and of giving insufficient coil shape when the coiling temperature becomes to below 400° C. caused from low ductility. For the case of hot dip zinc-coated steel sheet, there are several problems on attaining satisfactory ductility, including the problems of limitation on added amount of Si which is effective to improve ductility, and of unable to apply (ferrite+martensite) structure which is effective in ductility improvement for the use requiring high yield ratio.

SUMMARY OF THE INVENTION

The present invention was completed to solve the above-described problems, and an object of the present invention is to provide a high strength steel sheet having 340 MPa or higher strength and providing excellent stretch flanging performance, ductility, and shock resistance, and giving a sufficient coil shape and favorable surface properties even under hot dip zinc-coating treatment.

The object of the present invention is attained by a high strength steel sheet consisting essentially of 0.04 to 0.1% C, 0.5% or less Si, 0.5 to 2% Mn, 0.05% or less P, 0.005% or less 0, 0.005% or less S, by weight, having 10 $\mu$m or less of average ferritic grain size, and 20 mm/mm$^2$ or less of generation frequency A, which generation frequency A is defined as the total length of a banded secondary phase structure observed per 1 mm$^2$ of steel sheet cross section along the rolling direction thereof.

The high strength steel sheet is prepared by a manufacturing method comprising the steps of: hot-rolling a continuously cast slab having the composition described above at temperatures of $Ar_3$ transformation point or above directly or after reheating thereof; and cooling the hot-rolled steel sheet within 2 seconds down to the temperatures of from 600 to 750° C. at cooling speeds of from 100 to 2,000° C./sec, followed by coiling the cooled steel sheet at temperatures of from 450 to 650° C.

In particular, to further improve the ductility of high strength hot dip zinc-coated steel sheet having strengths of 440 MPa or more, it is preferred to apply a manufacturing method comprising the steps of: hot-rolling a steel slab consisting essentially of 0.01 to 0.3% C, 0.7% or less Si, 1 to 3% Mn, 0.08% or less P, 0.01% or less S, 0.08% or less sol.Al, and 0.007% or less N, by weight, at temperatures of $Ar_3$ transformation point or above; cooling the hot-rolled steel sheet within 2.5 seconds down to the temperatures ranging from above 500° C. to 700° C. at average cooling speeds of 100° C./sec or more, followed by coiling the cooled steel sheet; and pickling or cold-rolling after pickling the coiled steel sheet, then annealing thereto in a continuous hot dip zinc-coating line at temperatures of 720° C. or above to perform the zinc coating.

For completely preventing the degradation of surface properties caused from the cracks generated during hot-rolling, it is preferred to apply a manufacturing method comprising the steps of: hot-rolling a continuously cast slab consisting essentially of 0.05 to 0.2% C, 0.15% or less Si, 0.4 to 2.0% Mn, 0.025% or less P, 0.005% or less 0, 0.01% or less S, 0.006% or less N, and 0.004% or less Sn, by weight, and having Mn/S≧50 at temperatures of $Ar_3$ transformation point or above directly or after reheating the continuously cast slab; and cooling the hot-rolled steel sheet down to the temperatures of from 400° C. to 700° C. at cooling speeds of from 20 to 2,000° C./sec, followed by coiling the cooled steel sheet.

DETAILED DESCRIPTION OF THE INVENTION

Embodiment 1

The inventors of the present invention conducted detail study on the stretch flanging performance, the ductility, and the shock resistance of high strength steel sheets, and found that the elimination of the banded secondary phase structure existing over the whole range of the sheet thickness caused from the enrichment of C, Mn, and other elements is effective to improve the stretch flanging performance and the ductility, and that the increase of the yield strength of the steel sheet within a range not to degrade the workability of the steel sheet is effective to improve the shock resistance.

The high strength steel sheet according to the present invention was completed based on the findings. The following is the detail description of the present invention.

1. Composition

Carbon is an element necessary to assure the strength. If the C content is less than 0.04%, the strength of 340 MPa or more cannot be obtained. If the C content exceeds 0.1%, the workability degrades. Accordingly, the C content is specified to a range of from 0.04 to 0.1%.

Silicon is an element to strengthen by solid solution and an element necessary to assure the strength. If the Si content exceeds 0.5%, the surface properties degrade. Consequently, the Si content is specified to 0.5% or less.

Manganese is an element to strengthen by solid solution and is an effective element for improving the toughness. If the Mn content is less than 0.5%, the effect cannot be attained. If the Mn content exceeds 2%, the degradation of workability becomes significant. Therefore, the Mn content is specified to a range of from 0.5 to 2%.

Phosphorus is an element to strengthen by solid solution. If the P content exceeds 0.05%, the segregation thereof induces the degradation of workability. Thus, the P content is specified to 0.05% or less.

Oxygen above 0.005% content likely induces the cracks on the surface or below the surface of slab during continuous casting. Therefore, the O content is specified to 0.005% or less.

Sulfur above 0.005% content leads to the increase in sulfide and degrades the workability. Consequently, the S content is specified to 0.005% or less. In particular, for establishing good balance of strength and stretch flanging performance, the S content is preferably specified to 0.003% or less.

2. Structure

In a hot-rolled steel sheet, a hot-rolled steel sheet treated by alloyed hot dip zinc-coating, a hot-rolled steel sheet treated by cold-rolling followed by alloyed hot dip zinc-coating, and the like, ferritic grains are preferably in small size as far as possible by finely dispersing the secondary phase structure of carbide, pearlite, bainite, martensite, austenite, and the like to assure good balance of strength and ductility. When that type of secondary phase structure is formed in banded pattern, the balance of strength and elongation degrades.

Figure 1:
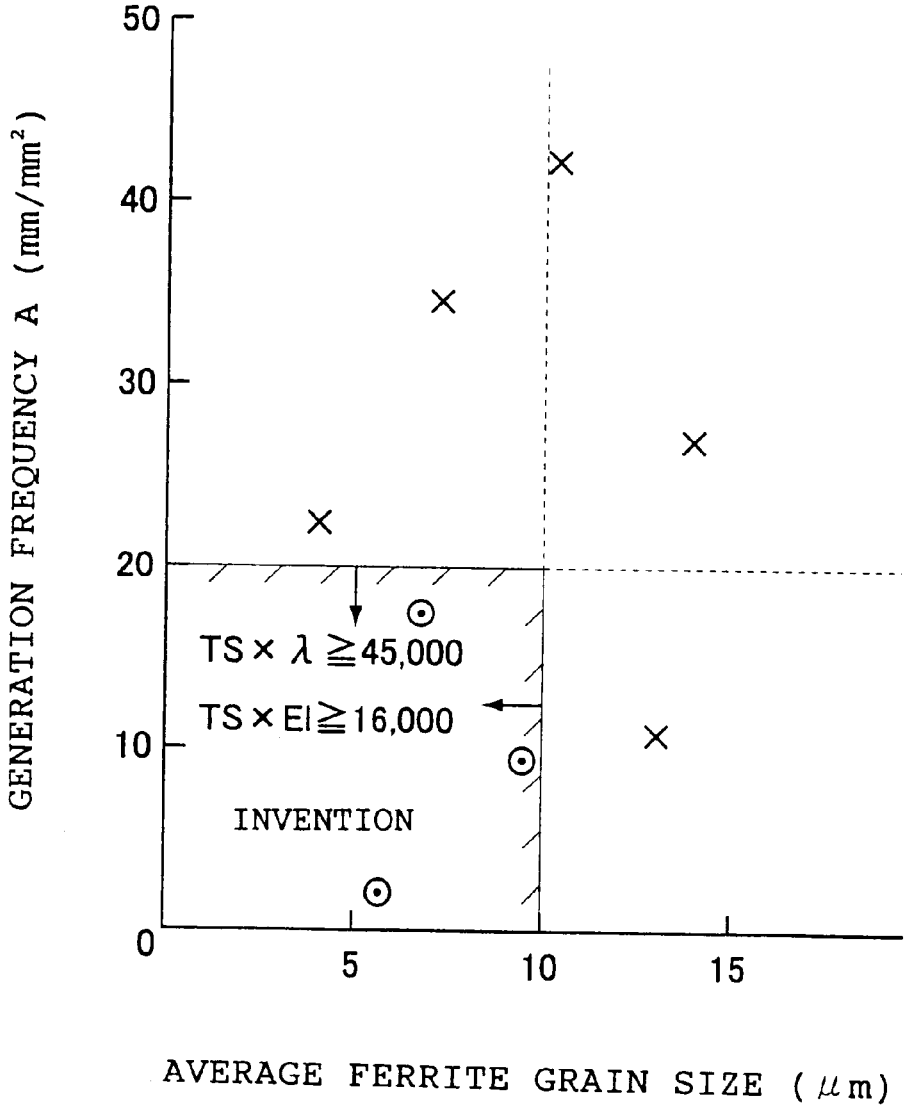
FIG. 1 is a graph showing the relation between TS×El, TS×λ, average ferritic grain size, and generation frequency A of banded secondary phase structure.

When the total length of the banded secondary phase structure observed per 1 $mm^2$of sheet cross sectional area along the rolling direction is defined as the generation frequency A, it is found that, as shown in FIG. 1, in the case of 10 μm or less of average ferritic grain size and of 20 $mm/mm^2$ or less of generation frequency A, excellent balance of strength and ductility (TS×El) and balance of strength and stretch flanging performance (TS×λ) can be attained. The term λ signifies the hole expanding rate normally used for evaluating the stretch flanging performance. The range of generation frequency A of 20 $mm/mm^2$ or less includes the case of 0 $mm/mm^2$, that is, the case in which no secondary phase structure is observed.

Furthermore, since the yield strength of the high strength steel sheet according to the present invention is increased by refining ferritic grains and secondary phase structure, the shock resistance is also excellent.

The high strength steel sheet according to the present invention may further contain 0.01 to 0.3% as the sum of at least one element selected from the group consisting of Ti, Nb, V, Mo, and Cr, adding to the above-described components, to improve the strength.

When the high strength steel sheet according to the present invention is regulated in the variations of tensile strength in the width direction and in the longitudinal direction of the steel sheet to within ±8% to the average value thereof, preferably within ±4%, and more preferably within ±2%, the variations of workability such as spring back during bending work can be significantly reduced.

The high strength steel sheet according to the present invention can be prepared by, for example, a manufacturing method comprising the steps of: hot-rolling a continuously cast slab having the above-described composition at temperatures of $Ar_3$ transformation point or above directly or after reheating thereof; and cooling the hot-rolled steel sheet within 2 seconds down to the temperatures ranging from 600 to 750° C. at cooling speeds of from 100 to 2,000° C./sec, followed by coiling the cooled steel sheet at temperatures ranging from 450 to 650° C.

The hot-rolling can be conducted by rolling the continuously cast slab in as-cast state or by rolling after reheating. It is, however, necessary to complete the rolling at temperatures of $Ar_3$ transformation point or above to refine the ferritic grains and the secondary phase structure after the transformation, to improve the balance of strength and ductility of steel sheet, and to improve the balance of strength and stretch flanging performance thereof. In that case, when the continuously cast slab is reheated, it is preferable to heat the slab to 1,250° C. or below.

After the hot-rolling, it is necessary to apply cooling (primary cooling) within 2 seconds at cooling speeds of from 100 to 2,000° C./sec to refine the ferritic grains and the secondary phase structure after the transformation and to improve the stretch flanging performance by bringing the generation frequency A, as the total length of the above-described secondary phase structure, to 20 mm/mm$^2$or less. If the cooling starts after longer than 2 seconds from hot-rolling, the ferritic grains and the secondary phase structure cannot be refined. From the point of suppression of the formation of banded secondary phase structure, it is preferable to homogenize the austenite structure before the transformation. To do this, the cooling is preferably started after more than 0.5 second. If the cooling speed is less than 100° C./sec, the structure formation responding to the C and Mn enriched section formed during the solidification proceeds to likely form the banded secondary phase structure, which fails to establish 20 mm/mm$^2$ or less of generation frequency A. If the cooling speed is 100° C./sec or more, higher cooling speed is more preferred, and, 200° C./sec or more, further 400° C./sec or more is preferable. From the industrial application view, however, the upper limit of the cooling speed is 2,000° C./sec.

Figure 2:
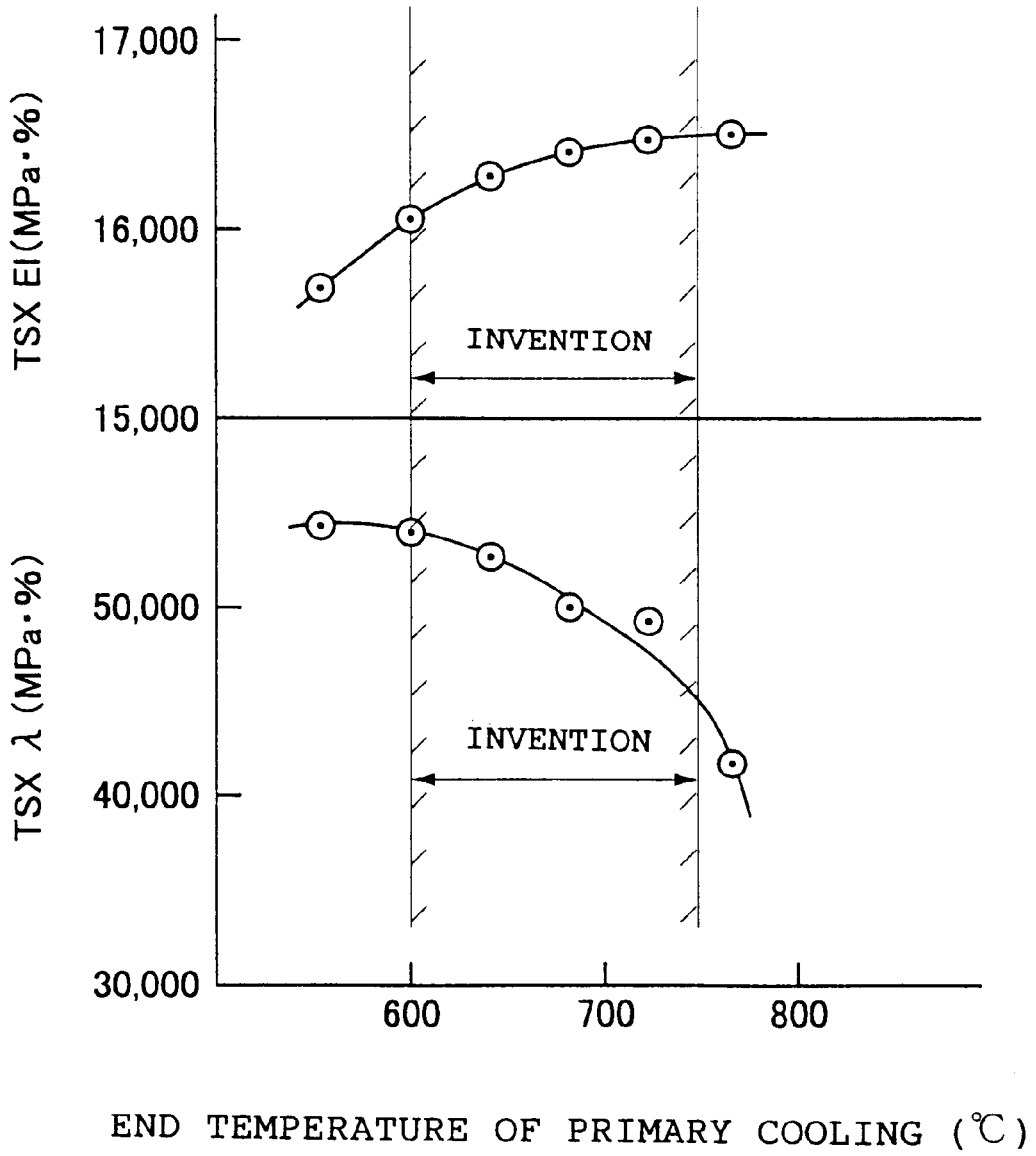
FIG. 2 is a graph showing the relation between primary cooling speed, TS×El, and TS×λ.

With the end temperature of cooling with that level of cooling speed, if the temperature is above 750° C., the ferritic grains are not refined to result in nonuniform dispersion of the secondary phase, as seen in FIG. 2, thus lowering the value of TS×λ, and, if the temperature is below 600° C., the secondary phase becomes a hard low temperature transformed phase, which lowers the value of TS×El. Therefore, the temperature is necessary to be between 600 and 750° C.

After that, for example, it is necessary to apply the cooling (secondary cooling) at approximate cooling speeds of less than 50° C./sec, and to apply the coiling of the steel sheet at temperatures of from 450 to 650° C. The reason is that coarse pearlite harmful to ductility is formed at temperatures higher than 650° C., and that low temperature transformed phase harmful to workability is formed at temperatures below 450° C. To establish homogeneous mechanical properties, the difference in coiling temperatures in a coil is preferably to set within 50° C.

When the coiled steel sheet is pickled and annealed, or pickled, cold-rolled, and annealed, the manufactured high strength hot-rolled steel sheet and high strength cold-rolled steel sheet have further excellent balance of strength and ductility, balance of strength and stretch flanging, and shock resistance.

To assure the above-described generation frequency A of 20 mm/mm$^2$ or less, it is preferred to suppress segregation of elements such as Mn and C through the treatment to reduce segregation during the continuous casting by separate or combined electromagnetic agitation, slight drafting casting, rapid cooling of slab, and the like.

When the variations in temperature in the width direction and in the longitudinal direction of the steel sheet after cooled at cooling speeds of from 100 to 2,000° C./sec to a temperature range of 60° C. or less through the cooling with 2,000 kcal/m$^2$h° C. or higher heat transfer coefficient, the above-described high strength steel sheet having within ±8% of the above-described tensile strength to the average value can be manufactured. To attain the variations of tensile strength within ±4% or ±2% to the average value, the cooling is conducted with the heat transfer coefficients of 5,000 kcal/m$^2$h° C. or more or 8,000 kcal/m$^2$h° C. or more to control the variations of above-described temperature within 40° C. or 20° C., respectively. The cooling with that high level of heat transfer coefficient is difficult to be realized in conventional laminar cooling process. However, the perforated ejection type cooling process can realize the cooling.

For further reducing the variations of temperature after the cooling at cooling speeds of from 100 to 2,000° C./sec, it is effective to install an induction heating unit at inlet side of the finish-rolling mill or between stands of the finish-rolling mill to heat the steel sheet under rolling to conduct the temperature adjustment. In a continuous hot-rolling process using a coil box, the heating of the steel sheet maybe done before or after the coil box, between the stands of the rough-rolling mill, or before or after the welder.

The high strength steel sheet according to the present invention can be treated by hot dip zinc-coating. In that case, the annealing temperature is preferably in a range of from 650 to 850° C. in view of improvement of ductility.

EXAMPLE 1

Steel having the chemical composition given in Table 1 was prepared by melting. The steel was rolled under the conditions given in Table 2 to form hot-rolled steel sheets Nos. 1 through 6, each having a thickness of 2.3 mm. The hot-rolled steel sheets Nos. 1, through 4 were treated by segregation reduction during the slab casting. After that, the hot-rolled steel sheet No. 3 was treated by pickling, cold-rolling, and hot dip zinc-coating. The hot-rolled steel sheet No. 4 was treated by pickling and hot dip zinc-coating. Mechanical properties were determined on the steel sheets Nos. 1, 2, 5, and 6 which were left as-hot-rolled state, the steel sheet No. 3 as the hot dip zinc-coated cold-rolled steel sheet, and the steel sheet No. 4 as the hot dip zinc-coated hot-rolled steel sheet. The stretch flanging performance was evaluated by the hole expanding rate A determined by opening a hole of 10 mm in diameter with 12% of clearance on the steel sheet, and by expanding the hole from the burr formation side using a conical punch.

The result is shown in Table 3.

The steel sheets Nos. 1 through 4 and 6 as Examples of the present invention give superior balance of strength and ductility and balance of strength and stretch flanging performance to the steel sheet No. 5 as a Comparative Example treated by the primary cooling speed, after the hot-rolling, of outside the range of the present invention, and give high yield strength and excellent shock resistance. In particular, for the steel sheets Nos. 1 through 4 which were treated to reduce segregation during the continuous casting provide high value of λ and excellent stretch flanging performance.

TABLE 1

| Composition (wt. %) | | | | | | |
|---|---|---|---|---|---|---|
| C | Si | Mn | S | P | O | N |
| 0.056 | 0.01 | 1.25 | 0.002 | 0.014 | 0.0025 | 0.0036 |

TABLE 2

| Steel sheet No. | Slab: Heat-treatment history | Slab: Treatment to reduce segregation | Finishing temperature of rolling (° C.) | Time to start the primary cooling (sec) | Primary cooling speed (° C./sec) | End temperature of the primary cooling (° C.) | Secondary cooling speed (° C./sec) | Remark |
|---|---|---|---|---|---|---|---|---|
| 1 | Casting, then heating to 1,250° C. | Applied | $Ar_3 - (Ar_3 + 25)$ | 1.3 | 210 | 640 | 35 | Example |
| 2 | Casting, then heating to 1,250° C. | Applied | $Ar_3 - (Ar_3 + 30)$ | 0.5 | 205 | 680 | 40 | Example |
| 3 | Casting, then heating to 1,250° C. | Applied | $Ar_3 - (Ar_3 + 25)$ | 0.6 | 210 | 640 | 45 | Example |
| 4 | Casting, then heating to 1,250° C. | Applied | $Ar_3 - (Ar_3 + 30)$ | 0.6 | 205 | 640 | 40 | Example |
| 5 | Casting, then heating to 1,250° C. | Applied | $(Ar_3 + 10) - (Ar_3 + 35)$ | 0.5 | 30* | 705 | 40 | Comparative example |
| 6 | Casting, then heating to 1,250° C. | Not applied | $(Ar_3 + 10) - (Ar_3 + 30)$ | 0.6 | 200 | 650 | 35 | Example |

*Outside of the range of the present invention

TABLE 3

| Steel sheet No. | Steel sheet Kind | Coiling temperature (° C.) | Ferrite average grain size (μm) | Generation frequency A (mm/mm²) | Mechanical properties YS (MPa) | TS (MPa) | El (%) | λ (%) | Remark |
|---|---|---|---|---|---|---|---|---|---|
| 1 | Hot-rolled steel sheet | 580 | 5.6 | 2.0 | 390 | 450 | 36.2 | 118 | Example |
| 2 | Hot-rolled steel sheet | 585 | 6.6 | 17.7 | 383 | 445 | 37.0 | 113 | Example |
| 3 | Zinc-coated cold-rolled steel sheet | 580 | 5.6 | 2.5 | 370 | 440 | 37.5 | 120 | Example |
| 4 | Zinc-coated hot-rolled steel sheet | 580 | 5.7 | 2.3 | 385 | 453 | 37.1 | 137 | Example |
| 5 | Hot-rolled steel sheet | 585 | 10.3 | 42.8 | 310 | 441 | 36.2 | 84 | Comparative example |
| 6 | Hot-rolled steel sheet | 580 | 7.1 | 20.0 | 352 | 441 | 36.0 | 100 | Example |

EXAMPLE 2

Steel having the chemical composition given in Table 4 was prepared by melting. The steel was rolled under the conditions given in Table 5 to form hot-rolled steel sheets, each having a thickness of 2.8 mm. The steel sheets were annealed at 800° C., and were subjected to alloyed hot dip zinc-coating to prepare the steel sheets Nos. 7 through 9. The mechanical properties of these steel sheets were determined in the same procedure with that in the Example 1.

The result is shown in Table 5.

The steel sheets Nos. 7 and 8 as Examples of the present invention give superior balance of strength and ductility and balance of strength and stretch flanging performance, to the steel sheet No. 9 as a Comparative Example treated by the primary cooling speed, after the hot-rolling, of outside of the range of the present invention, and give high yield strength and excellent shock resistance.

TABLE 4

| Composition (wt. %) C | Si | Mn | P | S | O | N | Cr | V |
|---|---|---|---|---|---|---|---|---|
| 0.096 | 0.25 | 1.64 | 0.029 | 0.001 | 0.0025 | 0.0026 | 0.20 | 0.055 |

TABLE 5

| Steel sheet No. | Slab: Heat-treatment history | Slab: Treatment to reduce segregation | Finishing temperature of rolling (° C.) | Time to start the primary cooling (sec) | Primary cooling speed (° C./sec) | End temperature of the primary cooling (° C.) | Secondary cooling speed (° C./sec) |
|---|---|---|---|---|---|---|---|
| 7 | Casting, then heating to 1,250° C. | Applied | $Ar_3$—$(Ar_3 + 10)$ | 0.60 | 514 | 643 | 25 |
| 8 | Casting, then heating to 1,250° C. | Applied | $Ar_3$—$(Ar_3 + 5)$ | 0.55 | 497 | 673 | 30 |
| 9 | Casting, then heating to 1,250° C. | Applied | $Ar_3$—$(Ar_3 + 15)$ | 0.60 | 30* | 750 | 35 |

TABLE 5-continued

| Steel sheet No. | Coiling temperature (° C.) | Ferrite average grain size (μm) | Generation frequency A (mm/mm²) | Mechanical properties YS (MPa) | TS (MPa) | El (%) | λ (%) | Remark |
|---|---|---|---|---|---|---|---|---|
| 7 | 556 | 5.5 | 7.0 | 439 | 719 | 29.3 | 37 | E |
| 8 | 563 | 7.0 | 5.0 | 423 | 667 | 30.0 | 47 | E |
| 9 | 575 | 8.5 | 45.0 | 415 | 716 | 26.8 | 32 | C |

*Outside of the range of the present invention
E: Example
C: Comparative example

EXAMPLE 3

The steel having the chemical composition given in Table 4 was rolled under the conditions given in Table 6 to form hot-rolled steel sheets, each having a thickness of 2.8 mm. The steel sheets were annealed at 800° C., and were subjected to alloyed hot dip zinc-coating to prepare the steel sheets Nos. 10 and 11. The dispersion of mechanical properties of these steel sheets in the width direction and in the longitudinal direction of the steel sheet coil was determined.

The result is shown in Table 6.

The steel sheet No. 10 as an Example of the present invention, which was cooled with a heat transfer coefficient of 12,000 kcal/m²h° C., gives less temperature variations in the width direction and in the longitudinal direction of the steel sheet and less variations in mechanical properties to the steel sheet No. 11 as a Comparative Example which was cooled with a heat transfer coefficient of 1,000 kcal/m²h° C., that is, by a primary cooling speed outside of the range of the present invention. The average value of tensile strength of the steel sheet No. 10 was 604 MPa. The average value of tensile strength of the steel sheet No. 11 was 625 MPa.

TABLE 6

| Steel sheet No. | Slab Heat-treatment history | Slab Treatment to reduce segregation | Finishing temperature of rolling (° C.) | Time to start the primary cooling (sec) | Primary cooling speed (° C./sec) | Variations of end temperature of the primary cooling (° C.) | Secondary cooling speed (° C./sec) | Coiling temperature (° C.) | Variations of tensile characteristics TS (MPa) | El (%) | Structure | Remark |
|---|---|---|---|---|---|---|---|---|---|---|---|---|
| 10 | Casting, then heating to 1,250° C. | Applied | 860 | 0.60 | 510 | 623–653 | 10 | 560 | 595–613 | 32–35 | F + M* | E |
| 11 | Casting, then heating to 1,250° C. | Applied | 862 | 1.50 | 30 | 598–675 | 13 | 557 | 572–680 | 28–33 | F + M | C |

*F: Ferrite, M: Martensite
E: Example
C: Comparative example

Embodiment 2

The inventors of the present invention conducted detail study on the improvement of ductility of high strength steel sheets, focusing on the high strength hot dip zinc-coated steel sheets having 440 MPa or higher strength, and found that it is effective to make the structure formed during hot-rolling homogenize and refine by suppressing the formation of what is called the banded structure in which pearlite is distributed in laminar pattern, as in the above-described case, and to make the layered structure of ferrite and cementite within pearlite refine, or it is effective to establish fine pearlite lamella gap.

The method for manufacturing the high strength hot dip zinc-coated steel sheet according to the present invention was completed based on the findings. The following is the detail description of the present invention.

1. Composition

Carbon is an element necessary to assure the strength. If the C content is less than 0.01%, the strength of 440 MPa or more cannot be obtained. If the C content exceeds 0.3%, the formation of what is called the banded structure in which pearlite is distributed in layered pattern cannot be suppressed. Accordingly, the C content is specified to a range of from 0.01 to 0.3%, more preferably from 0.05 to 0.2%.

Silicon is an effective element to improve the ductility of steel. If the Si content increases, the adhesiveness of zinc coating and the surface appearance significantly degrade. Consequently, the Si content is specified to 0.7% or less.

Manganese is, similar with C, an essential element to secure strength. If, however, the Mn content is less than 1%, the strength of 440 MPa or higher level cannot be obtained. And, if the Mn content exceeds 3%, the formation of banded structure cannot be suppressed. Therefore, the Mn content is specified to a range of from 1 to 3%. When the low temperature transformed phase is not used, the Mn content is more preferably specified to a range of from 1 to 2%.

Phosphorus is a necessary element to assure strength by solid solution. If, however, the P content increases, the adhesiveness of zinc coating degrades. Consequently, the P content is specified to 0.08% or less.

Since increased content of S increases the inclusions in steel to degrade the workability, the S content is specified to 0.01% or less.

The content of sol.Al is limited to an amount that ordinary high strength steel sheet contains, or to 0.08% or less.

Similar with sol.Al, the N content is limited to an amount that ordinary high strength steel sheet contains, or to 0.007% or less.

2. Manufacturing Conditions

On applying hot-rolling to a steel slab having the above-described composition, hot-rolling is required to be carried out at temperatures of $Ar_3$ transformation point or above not to leave the working structure to degrade the ductility.

After completing the hot-rolling, it is necessary to apply cooling (primary cooling) with average cooling speeds of 100° C./sec or more, preferably 110° C./sec or more, within 2.5 seconds to establish homogeneous fine structure and fine pearlite lamella gap. In that case, if the cooling starts after 2.5 seconds after completed the hot-rolling, the structure and the pearlite become coarse to degrade the ductility.

Regarding the end temperature of cooling in the cooling with that cooling speed, if the cooling proceeds to 500° C. or below, large amount of low temperature transformed phase such as bainite and martensite is formed, which then becomes acicular ferrite during annealing in the continuous hot dip zinc-coating line to degrade the ductility. Therefore, the end temperature of cooling is required to exceed 500° C. If the cooling proceeds to above 700° C., the sufficiently large C diffusion rate likely forms banded structure, and the pearlite lamella gap increases to fail to attain sufficient ductility. Therefore, the end temperature of cooling is necessary to be 700° C. or above.

The steel sheet cooled to that end temperature of cooling is coiled at the end temperature of cooling or coiled at a specified temperature after cooled (secondary cooling) at normal cooling speeds of 30° C./sec or less, followed by pickled or pickled and cold-rolled, then is annealed and coated in the continuous hot dip zinc-coating line. In the continuous hot dip zinc-coating line, when the annealing is carried out at temperatures of 720° C. or above, the resolution of coarse pearlite in the colony formed during the hot-rolling or of pearlite pulverized during cold-rolling proceeds to reduce the number of origins of cracks under plastic deformation, which then improves the ductility. Particularly for increasing the strength using the slight amount of low temperature transformed phase such as bainite and austenite, the inversely transformed austenite is stably obtained by enhancing the resolution of pearlite during annealing, which gives significant increase in the ductility.

Adding to the above-described components, the addition of one or more elements selected from the group consisting of 0.005 to 0.5% Nb, 0.005 to 0.5% Ti, and 0.0002 to 0.005% B, and/or one or more elements selected from the group consisting of 0.01 to 1% V, 0.01 to 1% Cr, and 0.01 to 1% Mo is effective to obtain high strength and fine structure. The reasons of limiting the contents are described in the following.

Niobium and Ti are effective elements to obtain fine structure and high strength by precipitation hardening. To obtain these effects, the content of Nb and Ti is necessary to be 0.005% or more. If, however, the content exceeds 0.5%, the effect saturates and the ductility degrades. From the viewpoint of ductility, the content is preferably 0.1% or less.

Boron is an effective element to suppress the precipitation of ferrite and to increase the strength by forming low temperature transformed phase. To attain the effect, the B content is necessary to be 0.0002% or more. If, however, the B content exceeds 0.005%, the effect saturates and the ductility degrades.

The elements of V, Cr, and Mo are effective to increase the hardenability of steel to increase the strength. To attain the effect, the content is necessary to be 0.01% or more. If the content exceeds 1%, the effect saturates.

When the cooling starts within very short time of 0.5 second or less after the hot-rolling, the rolled structure is cooled in an incompletely recrystallized state so that the structure likely becomes non-homogeneous, thus tending to increase in the dispersion of material quality in the longitudinal direction and in the width direction of the coil. Accordingly, the cooling preferably starts after the hot-rolling in a period of from more than 0.5 second to not more than 2.5 seconds.

The present invention can be implemented by slab ingot making process or continuous casting process. For the hot-rolling, the continuous hot-rolling technology which connects sheet bars after rough-rolling can be applied. Furthermore, an induction heating unit can be used during the hot-rolling to heat the steel, for example, within a range of 200° C. or below. The effect of the present invention is not affected under alloying after zinc-coated.

EXAMPLE 1

Steels A through E having chemical compositions given in Table 7 were prepared by melting. The steels were rolled under the conditions given in Table 8 to form hot-rolled steel sheets Nos. 1 through 35, each having a thickness of 2.3 or 2.8 mm. After applying pickling, the hot-rolled steel sheets Nos. 1 through 22 and No. 35 were annealed in as-hot-rolled state, and the hot-rolled steel sheets Nos. 23 through 34 were annealed after cold-rolled at 62% of reduction in thickness, under the heat treatment conditions equivalent to the continuous hot dip zinc-coating line shown in Table 9 using a laboratory heat treatment simulator. The steel microstructure was observed, and the tensile strength (TS) and the ductility (El) in the rolling direction and in the tranversal direction to the rolling direction were determined on JIS Class 5 specimens.

Figure 3:
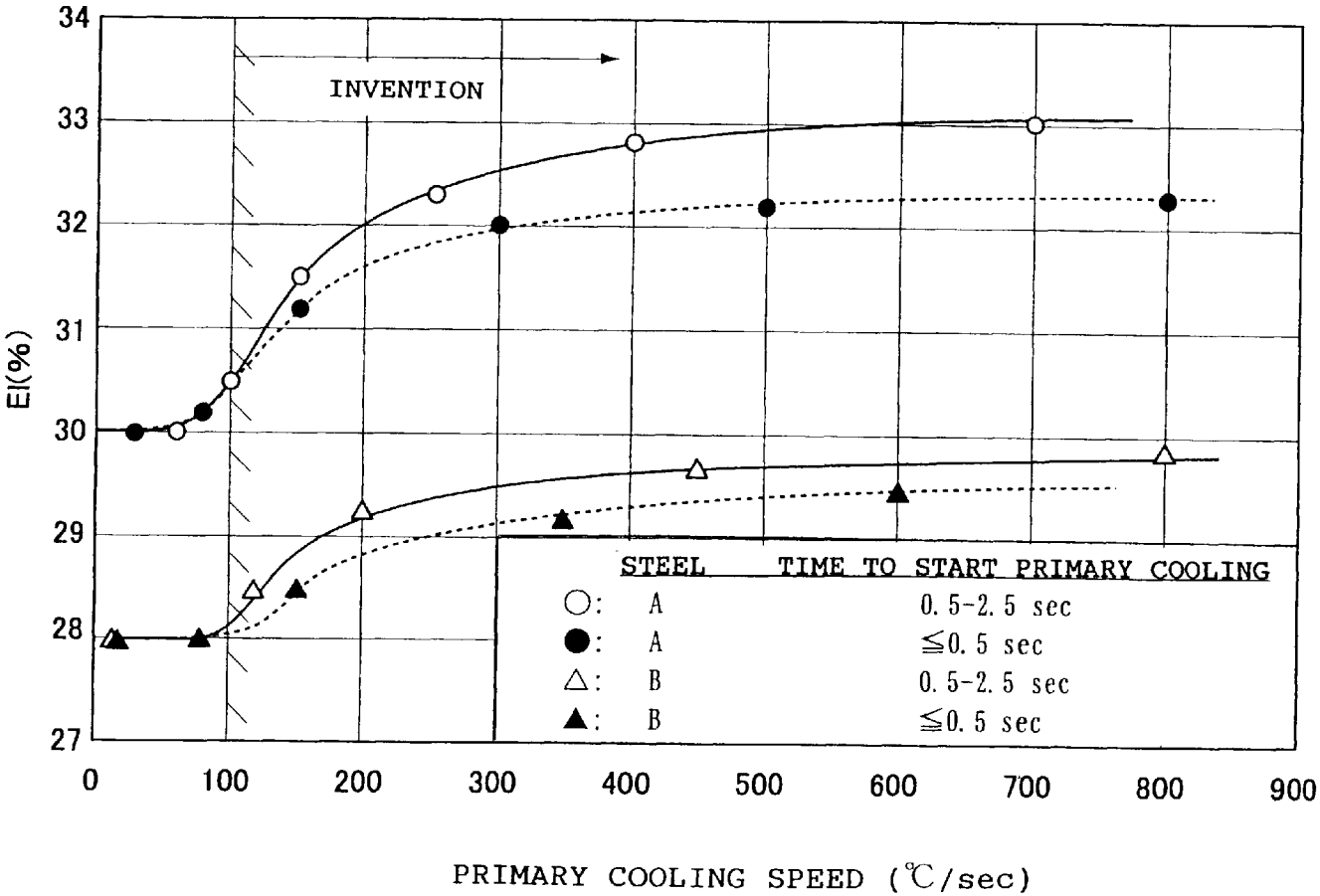
FIG. 3 is a graph showing the relation between primary cooling speed and El.

The result is given in Table 9. FIG. 3 shows the relation between the primary cooling speed and the El value of the hot-rolled steel sheets Nos. 1 through 22.

When comparison is given on the same strength level, the El value improves by controlling the primary cooling speed within the range of the present invention. Particularly when the control of the time to start cooling is given in a range of more than 0.5 second and not more than 2.5 seconds, the effect becomes significant. As for the hot-rolled steel sheets Nos. 1 through 12 which comprises the (ferrite+martensite) structure, the ductility increased by about 1% compared with the hot-rolled steel sheets Nos. 13 through 22 which were strengthened by precipitation hardening on the basis of the {ferrite+pearlite (+cementite)} structure.

TABLE 7

| Steel | Composition (wt. %) | | | | | | | |
|---|---|---|---|---|---|---|---|---|
| | C | Si | Mn | P | S | sol. Al | N | Other |
| A | 0.08 | 0.25 | 1.65 | 0.03 | 0.001 | 0.02 | 0.0025 | Cr: 0.2, V: 0.05 |
| B | 0.065 | 0.1 | 1.5 | 0.012 | 0.003 | 0.019 | 0.0025 | Nb: 0.03 |
| C | 0.180 | 0.02 | 2.5 | 0.015 | 0.001 | 0.03 | 0.0021 | Cr: 0.1, Nb: 0.03 |
| D | 0.07 | 0.03 | 2.6 | 0.012 | 0.004 | 0.025 | 0.0031 | Ti: 0.03, B:0.001 |
| E | 0.05 | 0.15 | 2.3 | 0.018 | 0.0008 | 0.035 | 0.0031 | — |

TABLE 8

| Steel sheet No. | Steel | Slab heating temperature (° C.) | Finishing temperature of rolling (° C.) | Time to start the primary cooling (sec) | Primary cooling speed (° C./sec) | End temperature of the primary cooling (° C.) | Secondary cooling speed (° C./sec) | Coiling temperature (° C.) | Sheet thickness after hot-rolling (mm) | Remark |
|---|---|---|---|---|---|---|---|---|---|---|
| 1 | A | 1230 | 880 | 1.5 | 30* | 600 | — | 600 | 2.3 | C |
| 2 | A | 1230 | 880 | 0.6 | 60* | 600 | 10 | 550 | 2.3 | C |
| 3 | A | 1230 | 880 | 1.5 | 80* | 600 | 10 | 550 | 2.3 | C |
| 4 | A | 1230 | 880 | 0.6 | 100 | 600 | 10 | 550 | 2.3 | E |
| 5 | A | 1230 | 880 | 2.1 | 150 | 600 | 10 | 550 | 2.3 | E |
| 6 | A | 1230 | 880 | 0.4 | 150 | 600 | 10 | 550 | 2.3 | E |
| 7 | A | 1230 | 880 | 0.6 | 250 | 600 | 10 | 550 | 2.3 | E |
| 8 | A | 1230 | 880 | 0.3 | 300 | 600 | 10 | 550 | 2.3 | E |
| 9 | A | 1230 | 880 | 0.6 | 400 | 600 | 10 | 550 | 2.3 | E |
| 10 | A | 1230 | 880 | 0.2 | 500 | 600 | 10 | 550 | 2.3 | E |
| 11 | A | 1230 | 880 | 1.3 | 700 | 600 | 5 | 550 | 2.3 | E |
| 12 | A | 1230 | 880 | 0.3 | 800 | 600 | 10 | 550 | 2.3 | E |
| 13 | B | 1230 | 860 | 0.5 | 15* | 620 | — | 620 | 2.3 | C |
| 14 | B | 1230 | 860 | 1.5 | 20* | 620 | — | 620 | 2.3 | C |
| 15 | B | 1230 | 860 | 1.5 | 80* | 650 | 10 | 620 | 2.3 | C |
| 16 | B | 1230 | 860 | 0.8 | 120 | 650 | 10 | 620 | 2.3 | E |
| 17 | B | 1230 | 860 | 0.2 | 150 | 650 | 10 | 620 | 2.3 | E |
| 18 | B | 1230 | 860 | 0.6 | 200 | 650 | 10 | 620 | 2.3 | E |
| 19 | B | 1230 | 860 | 0.3 | 350 | 650 | 10 | 620 | 2.3 | E |
| 20 | B | 1230 | 860 | 1.0 | 450 | 650 | 10 | 620 | 2.3 | E |
| 21 | B | 1230 | 860 | 0.2 | 600 | 650 | 10 | 620 | 2.3 | E |
| 22 | B | 1230 | 860 | 0.7 | 800 | 650 | 10 | 620 | 2.3 | E |
| 23 | C | 1230 | 830 | 0.5 | 15* | 620 | — | 620 | 2.8 | C |
| 24 | C | 1230 | 830 | 0.5 | 80* | 650 | 5 | 620 | 2.8 | C |
| 25 | C | 1230 | 830 | 0.7 | 200 | 650 | 5 | 620 | 2.8 | E |
| 26 | C | 1230 | 830 | 0.7 | 600 | 650 | 5 | 620 | 2.8 | E |
| 27 | D | 1230 | 850 | 0.5 | 20* | 530 | — | 530 | 2.8 | C |
| 28 | D | 1230 | 850 | 0.8 | 300 | 580 | 10 | 530 | 2.8 | E |
| 29 | E | 1230 | 850 | 1.3 | 10* | 600 | — | 600 | 2.8 | C |
| 30 | E | 1230 | 850 | 0.3 | 150 | 650 | 5 | 600 | 2.8 | E |
| 31 | E | 1230 | 850 | 0.3 | 300 | 650 | 5 | 600 | 2.8 | E |
| 32 | E | 1230 | 850 | 0.3 | 600 | 650 | 5 | 600 | 2.8 | E |
| 33 | E | 1230 | 850 | 1.3 | 400 | 650 | 5 | 600 | 2.8 | E |
| 34 | E | 1230 | 850 | 1.3 | 600 | 650 | 5 | 600 | 2.8 | E |
| 35 | A | 1230 | 880 | 3.0* | 500 | 600 | 10 | 550 | 2.3 | C |

*Outside of the range of the present invention
E: Example
C: Comparative example

TABLE 9

| Steel sheet No. | Steel | Primary cooling speed (° C./sec.) | Reduction in thickness during cold-rolling (%) | Final sheet thickness (mm) | Condition of hot dip zinc-coating: Soaking temperature (° C.) | Condition of hot dip zinc-coating: Alloying performance | Micro-structure | Tensile characteristics: TS (MPa) | Tensile characteristics: El (%) | Remark |
|---|---|---|---|---|---|---|---|---|---|---|
| 1 | A | 30* | — | 2.3 | 800 | ○ | F + M | 620 | 30.0 | C |
| 2 | A | 60* | — | 2.3 | 800 | ○ | F + M | 618 | 30.0 | C |
| 3 | A | 80* | — | 2.3 | 800 | ○ | F + M | 621 | 30.2 | C |
| 4 | A | 100 | — | 2.3 | 800 | ○ | F + M | 620 | 30.5 | E |
| 5 | A | 150 | — | 2.3 | 800 | ○ | F + M | 623 | 31.5 | E |
| 6 | A | 150 | — | 2.3 | 800 | ○ | F + M | 619 | 31.2 | E |
| 7 | A | 250 | — | 2.3 | 800 | ○ | F + M | 620 | 32.3 | E |

TABLE 9-continued

| Steel sheet No. | Steel | Primary cooling speed (° C./sec.) | Reduction in thickness during cold-rolling (%) | Final sheet thickness (mm) | Condition of hot dip zinc-coating: Soaking temperature (° C.) | Condition of hot dip zinc-coating: Alloying performance | Micro-structure | Tensile characteristics: TS (MPa) | Tensile characteristics: El (%) | Remark |
|---|---|---|---|---|---|---|---|---|---|---|
| 8 | A | 300 | — | 2.3 | 800 | ○ | F + M | 622 | 32.0 | E |
| 9 | A | 400 | — | 2.3 | 800 | ○ | F + M | 621 | 32.8 | E |
| 10 | A | 500 | — | 2.3 | 800 | ○ | F + M | 620 | 32.2 | E |
| 11 | A | 700 | — | 2.3 | 800 | ○ | F + M | 625 | 33.0 | E |
| 12 | A | 800 | — | 2.3 | 800 | ○ | F + M | 622 | 32.3 | E |
| 13 | B | 15* | — | 2.3 | 750 | X | F + P (or + C) | 599 | 28.0 | C |
| 14 | B | 20* | — | 2.3 | 750 | X | F + P (or + C) | 600 | 28.0 | C |
| 15 | B | 80* | — | 2.3 | 750 | X | F + P (or + C) | 602 | 28.0 | C |
| 16 | B | 120 | — | 2.3 | 750 | X | F + P (or + C) | 600 | 28.5 | E |
| 17 | B | 150 | — | 2.3 | 750 | X | F + P (or + C) | 598 | 28.5 | E |
| 18 | B | 200 | — | 2.3 | 750 | X | F + P (or + C) | 603 | 29.3 | E |
| 19 | B | 350 | — | 2.3 | 750 | X | F + P (or + C) | 600 | 29.2 | E |
| 20 | B | 450 | — | 2.3 | 750 | X | F + P (or + C) | 597 | 29.7 | E |
| 21 | B | 600 | — | 2.3 | 750 | X | F + P (or + C) | 602 | 29.5 | E |
| 22 | B | 800 | — | 2.3 | 750 | X | F + P (or + C) | 604 | 29.9 | E |
| 23 | C | 15* | 62 | 1.2 | 830 | ○ | F + M | 1010 | 15.0 | C |
| 24 | C | 80* | 62 | 1.2 | 830 | ○ | F + M | 1006 | 15.0 | C |
| 25 | C | 200 | 62 | 1.2 | 830 | ○ | F + M | 1008 | 16.0 | E |
| 26 | C | 600 | 62 | 1.2 | 830 | ○ | F + M | 1012 | 17.0 | E |
| 27 | D | 20* | 62 | 1.2 | 800 | ○ | F + M | 810 | 21.0 | C |
| 28 | D | 300 | 62 | 1.2 | 800 | ○ | F + M | 815 | 22.5 | E |
| 29 | E | 10* | 62 | 1.2 | 780 | X | F + B + M | 599 | 29.0 | C |
| 30 | E | 150 | 62 | 1.2 | 780 | X | F + B + M | 603 | 29.5 | E |
| 31 | E | 300 | 62 | 1.2 | 780 | X | F + B + M | 601 | 30.0 | E |
| 32 | E | 600 | 62 | 1.2 | 780 | X | F + B + M | 600 | 30.0 | E |
| 33 | E | 400 | 62 | 1.2 | 780 | X | F+ B + M | 597 | 30.5 | E |
| 34 | E | 600 | 62 | 1.2 | 780 | X | F+ B + M | 602 | 31.5 | E |
| 35 | A | 500 | — | 2.3 | 800 | ○ | F + M | 621 | 30.0 | C |

*Outside of the range of the present invention,
F: Ferrite,
M: Martensite,
P: Pearlite,
C: Cementite,
B: Bainite
E: Example
C: Comparative example

Embodiment 3

As described above, when the high strength steel sheets having strengths of 340 MPa or more are manufactured, the cracks likely occur during the hot-rolling to degrade the surface properties, which results in reduced yield. The surface defects caused from the cracks occurred in hot-rolling step presumably come from the occurrence of cracks owing to red shortness appeared on the surface or below the surface of the slab under bending deformation during the continuous casting, which cracks significantly develop in the succeeding rolling to result in the surface defects. In normal practice, the surface defects are prevented by trimming the slab. The slab trimming induces cost increase. And the direct rolling process which cannot implement the slab trimming cannot be applied.

The inventors of the present invention investigated the methods to maintain the above-described excellent workability such as stretch flanging performance and ductility, and the characteristics such as shock resistance, and to prevent the surface defects caused from the cracks occurred during the hot-rolling, and found that the high strength steel sheets having excellent surface properties can be obtained, even without applying slab trimming, by controlling the content of P, O, S, N, and Sn and the ratio of Mn/S in the steel, and furthermore, at need, by adding an adequate amount of Ca.

The method for manufacturing the high strength steel sheet according to the present invention was completed on the basis of these findings. The detail is described in the following.

1. Composition

Carbon is a necessary element to assure strength. If the C content is less than 0.05%, the crack occurrence on the surface or beneath the surface of slab during continuous casting cannot be suppressed. If the C content exceeds 0.2%, the workability degrades. Accordingly, the C content is specified to a range of from 0.05 to 0.2%, preferably from 0.05 to 0.1%.

Silicon is a necessary element to assure strength. If the Si content exceeds 0.15%, the surface properties degrade. Consequently, the Si content is specified to 0.15% or less.

Manganese is an effective element that can suppress the occurrence of cracks on the surface or beneath the surface of slab during continuous casting. If the Mn content is less than 0.4%, the effect cannot be attained. If the Mn content exceeds 2.0%, the workability degrades. Therefore, the Mn content is specified to a range of from 0.4 to 2.0%.

Phosphorus is a harmful element which enhances the crack occurrence on the surface or beneath the surface of slab during continuous casting. If the P content exceeds 0.025%, the crack occurrence becomes significant on the surface or beneath the surface of slab during continuous casting, and the frequency of crack occurrence in hot-rolling step increases. Accordingly, the P content is specified to 0.025% or less, preferably 0.010% or less.

Oxygen is a harmful element which enhances the crack occurrence on the surface or beneath the surface of slab during continuous casting. If the O content exceeds 0.005%, the slab crack occurrence becomes significant during continuous casting, and the workability of the steel sheet degrades. Accordingly, the O content is specified to 0.005% or less.

Sulfur is a harmful element which significantly enhances the crack occurrence on the surface or beneath the surface of slab during continuous casting, and which, even if no slab crack occurred, induces cracks during hot-rolling to degrade the surface properties of the steel sheet and to degrade the workability thereof. If the S content exceeds 0.01%, the occurrence of slab cracks becomes significant during continuous casting, and the workability of steel sheet degrades. Therefore, the S content is specified to 0.01% or less, preferably 0.005% or less, more preferably 0.001% or less.

Nitrogen is an element which should be reduced in the content thereof to suppress the crack occurrence during hot-rolling and to improve the workability of steel sheet. If the N content exceeds 0.006%, the crack occurrence during hot-rolling and the degradation in workability are induced. Accordingly, the N content is specified to 0.006% or less, preferably 0.005% or less.

Tin is an extremely harmful element which significantly enhances the crack occurrence on the surface or beneath the surface of slab during continuous casting. In recent years, however, there are increased uses of scrap in steel making, and the Sn content has increased. If the Sn content exceeds 0.004%, the crack occurrence on the surface or beneath the surface of slab during the continuous casting particularly becomes significant, which induces increased frequency of crack occurrence during hot-rolling. Therefore, the Sn content is specified to 0.004% or less.

Adding to the above-described limitations of components, Mn/S is specified to not less than 50 because the Mn/S below 50 significantly enhances the crack occurrence on the surface or beneath the surface of slab during the continuous casting.

2. Manufacturing Conditions

With the steel slabs having the above-described compositions, the occurrence of surface defects caused from the cracks on the surface or beneath the surface of slab during the continuous casting can be suppressed even when the slab is reheated and hot-rolled after the continuous casting without applying the slab trimming, or even when the slab is directly hot-rolled (direct rolling) without applying reheating. When, before the direct rolling, supplemental heating to 1,250° C. or below is applied, the brittleness of grain boundaries caused from sulfide is suppressed, and high strength steel sheet having further excellent surface properties and excellent workability is obtained. Since the method according to the present invention does not need slab trimming, the manufacturing cost is reduced and the direct rolling process can be applied.

The hot-rolling is necessary to be conducted at temperatures of $Ar_3$ transformation point or above to refine the ferritic grains and to improve the workability of the steel sheet.

After completed the hot-rolling, cooling is necessary to be given at cooling speeds of from 20 to 2,000° C./sec, preferably from 50 to 2,000° C./sec, more preferably from 120 to 2,000° C./sec to refine the ferritic grains and the pearlite after the transformation to improve the workability of the steel sheet.

When the steel sheets which were cooled at above-described cooling speeds are coiled at temperatures of below 400° C., the formation of low temperature transformed phase degrades the balance of strength and ductility. And, when the coiling is done at temperatures of above 700° C., the coarse pearlite which is harmful to ductility is generated. Therefore, the coiling is necessary to be done at temperatures of from 400 to 700° C.

Adding to the above-described components, if 0.005% or less of Ca is added, the crack occurrence on the surface or beneath the surface of slab during continuous casting is more surely suppressed. The reason of limiting the Ca content to 0.005% or less is that the Ca content of more than 0.005% increases the frequency of crack occurrence beneath the surface of slab.

When the reduction in thickness at the final stand during the hot-rolling is regulated to a range of from 8 to 30%, good coil shape is attained and improved workability of steel sheet is obtained owing to the sufficiently refined ferritic grains.

After completed the hot-rolling, start of the cooling within 1.0 second, preferably within 0.5 second suppresses the growth of austenitic grains after the rolling and before the transformation, thus provides a steel sheet having further excellent workability. Shorter time to start for cooling gives stronger effect. Since, however, the time to start for cooling within 0.1 second cannot be actualized because of the limitations of facilities, the lower limit of the time to start for cooling is specified to more than 0.1 second.

The high strength steel sheet having excellent surface properties and workability can also be obtained by applying normal method of cold-rolling and annealing to a coiled hot-rolled steel sheet to form a cold-rolled steel sheet.

On applying the present invention, when the whole of sheet bar or the edge portions thereof after the rough-rolling is heated before the finish-rolling, homogeneous workability is attained over the whole area of the coil. What is called the continuous hot-rolling technology which uses a coil box to apply hot-rolling while connecting the sheet bar can be applied to the present invention. In that case, the sheet bar heating may be done inside of the coil box, before or after the coil box, in the rough-rolling mills, or after the rough-rolling mill.

EXAMPLE 1

Steels Nos. 1 through 12 having the chemical compositions given in Table 10 were prepared by melting. The steels were hot-rolled under the conditions given in Table 11 to form hot-rolled steel sheets Nos. 1 through 12, each having a thickness of 3.0 mm. The tensile strength (TS) and the hole expanding rate (λ) were determined on each steel sheet using the above-described method. The surface properties of each of the steel sheets were visually inspected on the basis of the number of surface defects generated on the hot-rolled steel sheet coil, giving the three evaluation grades:

◎: zero (Present invention)
○: more than zero and not more than 2 (Present invention)
×: more than 2 (outside of the Present invention)

Figure 4:
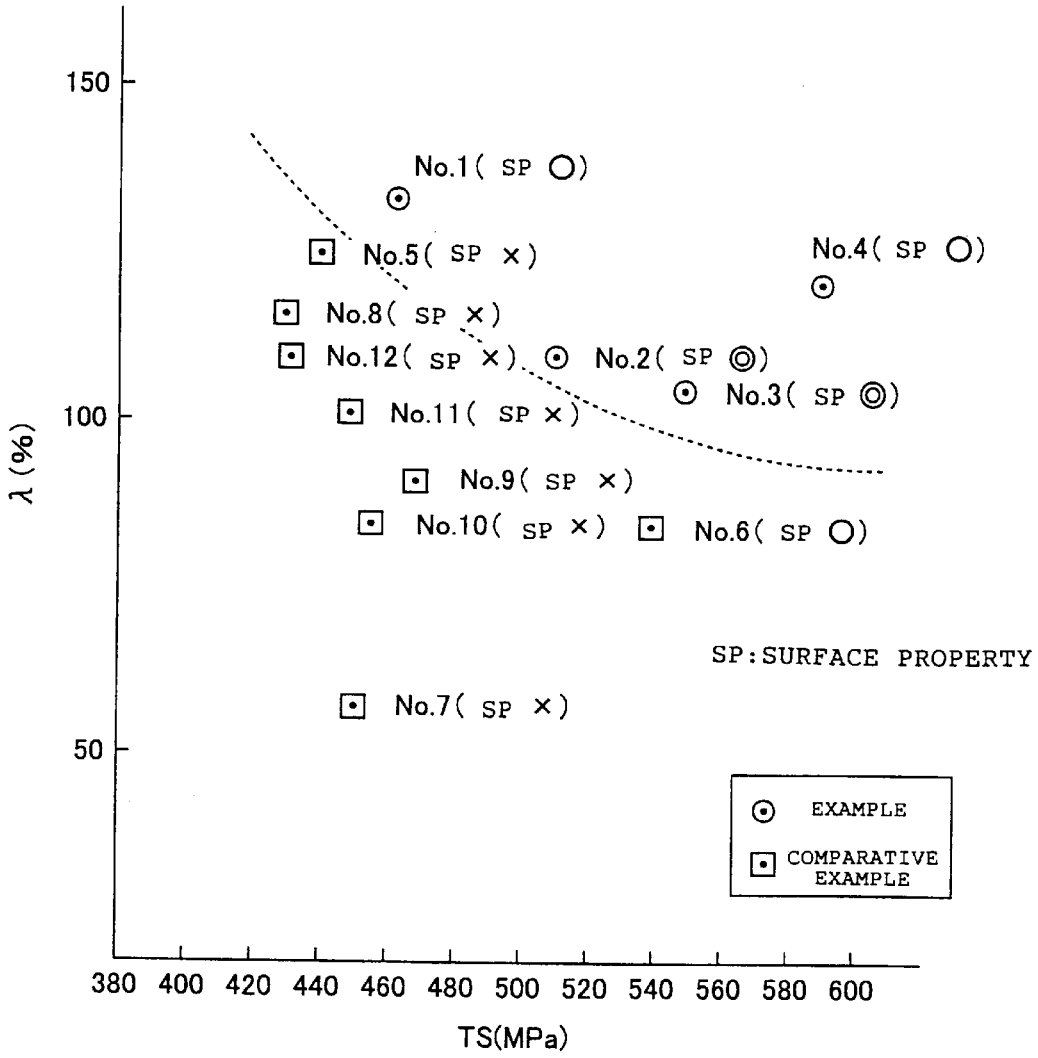
FIG. 4 is a graph showing the relation between TS, λ, and surface properties.

The result is shown in Table 11. FIG. 4 shows the relation between TS, λ, and surface properties.

The hot-rolled steel sheets Nos. 1 through 4 which are the Examples of the present invention give excellent surface properties. The hole expanding rate in the Examples of the present invention is superior to the hot-rolled steel sheets Nos. 5 through 12 which are Comparative Examples on the basis of the same strength level.

TABLE 10

| Steel | Composition (wt. %) | | | | | | | | | | | | |
|---|---|---|---|---|---|---|---|---|---|---|---|---|---|
| No. | C | Si | Mn | S | P | O | N | Sn | Mn/S | Ti | Nb | B | V |
| 1 | 0.0630 | 0.01 | 0.74 | 0.001 | 0.006 | 0.0024 | 0.0021 | 0.0030 | 740 | — | — | — | — |
| 2 | 0.0700 | 0.02 | 0.63 | 0.003 | 0.017 | 0.0021 | 0.0028 | 0.0020 | 210 | 0.052 | — | — | — |
| 3 | 0.1140 | 0.15 | 0.50 | 0.004 | 0.012 | 0.0025 | 0.0025 | 0.0010 | 125 | 0.015 | 0.020 | — | — |
| 4 | 0.1600 | 0.02 | 0.71 | 0.003 | 0.017 | 0.0019 | 0.0038 | 0.0020 | 237 | — | — | 0.001 | 0.020 |
| 5 | 0.1810 | 0.02 | 0.30* | 0.003 | 0.019 | 0.0020 | 0.0037 | 0.0020 | 100 | — | — | — | — |
| 6 | 0.0500 | 0.02 | 2.10* | 0.003 | 0.015 | 0.0023 | 0.0028 | 0.0030 | 700 | — | — | — | — |
| 7 | 0.1670 | 0.03 | 0.49 | 0.015* | 0.010 | 0.0060* | 0.0024 | 0.0040 | 33* | — | — | — | — |
| 8 | 0.1230 | 0.01 | 0.56 | 0.004 | 0.028* | 0.0027 | 0.0067* | 0.0020 | 140 | — | — | — | — |
| 9 | 0.1700 | 0.02 | 0.65 | 0.003 | 0.015 | 0.0055* | 0.0020 | 0.0055* | 217 | — | — | — | — |
| 10 | 0.1710 | 0.01 | 0.51 | 0.003 | 0.017 | 0.0031 | 0.0072* | 0.0020 | 170 | — | — | — | — |
| 11 | 0.1650 | 0.02 | 0.49 | 0.003 | 0.015 | 0.0028 | 0.0039 | 0.0050* | 163 | — | — | — | — |
| 12 | 0.1580 | 0.02 | 0.40 | 0.010 | 0.014 | 0.0035 | 0.0040 | 0.0040 | 40* | — | — | — | — |

*Outside of the range of the present invention

TABLE 11

| Steel | | Manufacturing condition | | | | Mechanical properties | | |
|---|---|---|---|---|---|---|---|---|
| sheet No. | Steel No. | Slab heat-treatment history | Cooling speed (° C./sec) | Coiling temperature (° C.) | Surface property | λ (%) | TS (MPa) | Remark |
| 1 | 1 | Direct rolling | 45 | 620 | ○ | 133 | 461 | Example |
| 2 | 2 | Heating to 1,150° C. | 60 | 572 | ⊙ | 110 | 510 | Example |
| 3 | 3 | Heating to 1,150° C. | 110 | 563 | ⊙ | 105 | 550 | Example |
| 4 | 4 | Direct rolling | 180 | 550 | ○ | 121 | 590 | Example |
| 5 | 5 | Direct rolling | 40 | 540 | X | 125 | 440 | Comparative Example |
| 6 | 6 | Direct rolling | 46 | 550 | ○ | 85 | 540 | Comparative Example |
| 7 | 7 | Direct rolling | 40 | 551 | X | 58 | 451 | Comparative Example |
| 8 | 8 | Direct rolling | 35 | 521 | X | 115 | 430 | Comparative Example |
| 9 | 9 | Direct rolling | 45 | 535 | X | 91 | 466 | Comparative Example |
| 10 | 10 | Direct rolling | 41 | 532 | X | 85 | 455 | Comparative Example |
| 11 | 11 | Direct rolling | 35 | 510 | X | 104 | 448 | Comparative Example |
| 12 | 12 | Direct rolling | 40 | 516 | X | 110 | 431 | Comparative Example |

EXAMPLE 2

The steels Nos. 1 and 2 shown in Table 10 were hot-rolled under the condition given in Table 12 to prepare hot-rolled steel sheets Nos. 13 through 20, each having a sheet thickness of 3.0 mm. The same evaluation with that in Example 1 was given.

Figure 5:
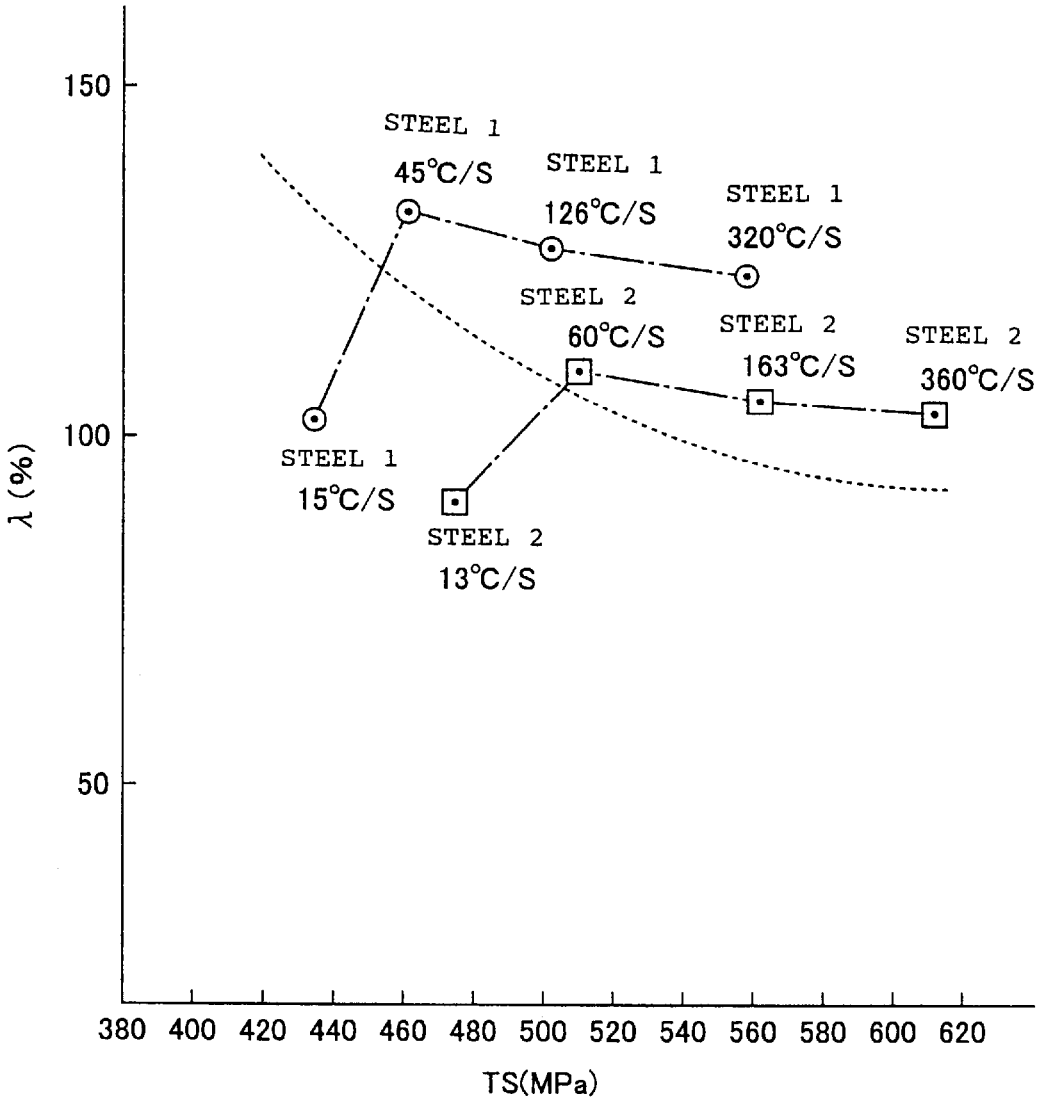
FIG. 5 is a graph showing the relation between TS, λ, and surface properties.

The result is shown in Table 12. FIG. 5 shows the relation between TS, λ, and surface properties.

The hot-rolled steel sheets Nos. 14 through 16 and 18 through 20 which are the Examples of the present invention give excellent surface properties. The hole expanding rate in the Examples of the present invention is superior to the hot-rolled steel sheets Nos. 13 and 17 which are Comparative Examples on the basis of the same strength level.

TABLE 12

| Steel | | Manufacturing condition | | | | Mechanical properties | | |
|---|---|---|---|---|---|---|---|---|
| sheet No. | Steel No. | Slab heat-treatment history | Cooling speed (° C./sec) | Coiling temperature (° C.) | Surface property | λ (%) | TS (MPa) | Remark |
| 13 | 1 | Heating to 1,150° C. | 15* | 605 | ⊙ | 103 | 435 | Comparative Example |
| 14 | 1 | Heating to 1,150° C. | 45 | 620 | ⊙ | 133 | 461 | Example |
| 15 | 1 | Heating to 1,150° C. | 126 | 618 | ⊙ | 128 | 502 | Example |

TABLE 12-continued

| Steel sheet No. | Steel No. | Manufacturing condition: Slab heat-treatment history | Cooling speed (° C./sec) | Coiling temperature (° C.) | Surface property | Mechanical properties: λ (%) | TS (MPa) | Remark |
|---|---|---|---|---|---|---|---|---|
| 16 | 1 | Heating to 1,150° C. | 320 | 624 | ◎ | 124 | 558 | Example |
| 17 | 2 | Direct rolling | 13* | 621 | ○ | 92 | 474 | Comparative Example |
| 18 | 2 | Direct rolling | 60 | 572 | ○ | 110 | 510 | Example |
| 19 | 2 | Direct rolling | 163 | 615 | ○ | 106 | 562 | Example |
| 20 | 2 | Direct rolling | 360 | 584 | ○ | 104 | 612 | Example |

*Outside of the range of the present invention

EXAMPLE 3

The steels Nos. 1 and 12 shown in Table 10 were hot-rolled under the condition given in Table 13 to prepare hot-rolled steel sheets Nos. 21 through 32, each having a sheet thickness of 3.0 mm. The same evaluation with that in Example 1 was given.

Figure 6:
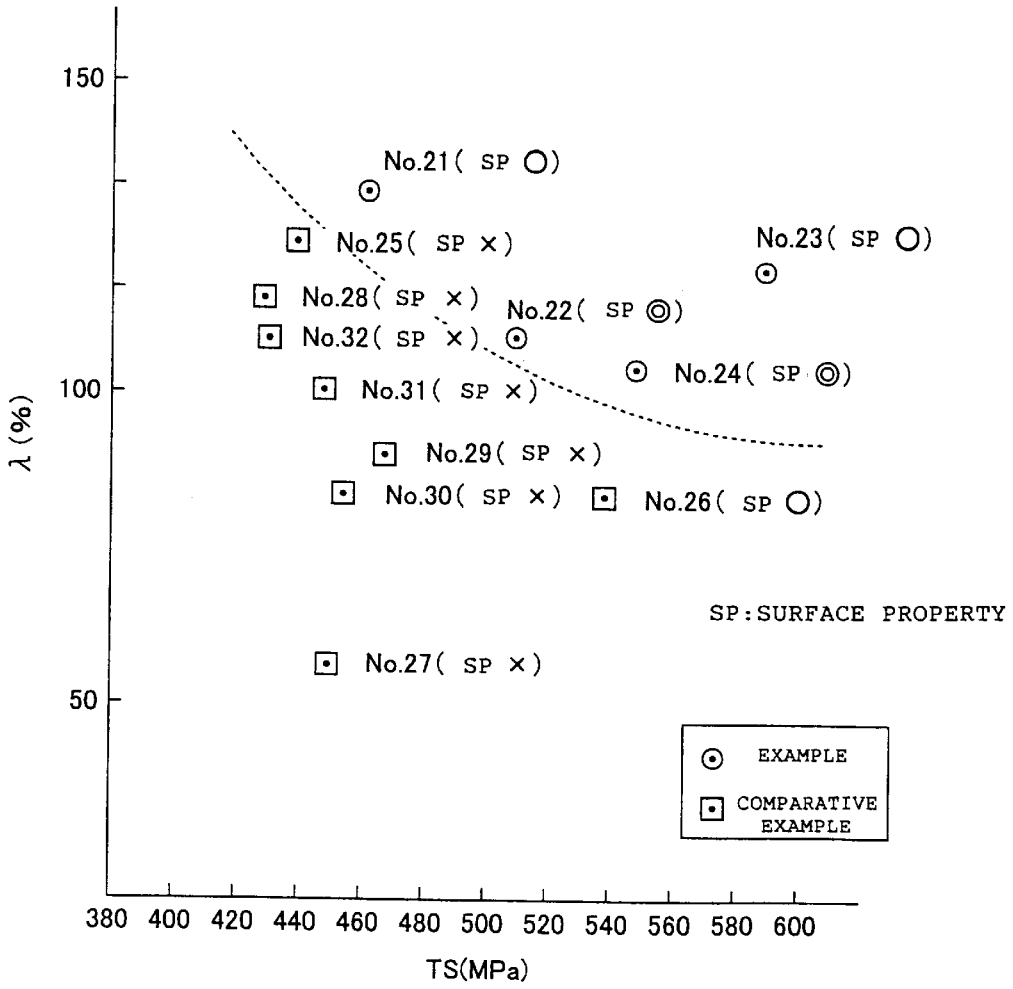
FIG. 6 is a graph showing the relation between TS, λ, and surface properties.

The result is shown in Table 13. FIG. 6 shows the relation ween TS, λ, and surface properties.

The hot-rolled steel sheets Nos. 21 through 24 which are the Examples of the present invention give excellent surface properties. The hole expanding rate in the Examples of the present invention is superior to the hot-rolled steel sheets Nos. 25 and 32 which are Comparative Examples on the basis of the same strength level. Furthermore, the shape of the hot-rolled coil in the Examples of the present invention was excellent.

TABLE 13

| Steel sheet No. | Steel No. | Manufacturing condition: Slab heat-treatment history | Final reduction in thickness (%) | Time to start cooling (sec) | Cooling speed (° C./sec) | Coiling temperature (° C.) | Coil shape | Surface properties | Mechanical properties: λ (%) | TS (MPa) | Remark |
|---|---|---|---|---|---|---|---|---|---|---|---|
| 21 | 1 | Heating to 1,200° C. | 10 | 0.2 | 45 | 620 | Good | ○ | 135 | 460 | Example |
| 22 | 2 | Heating to 1,200° C. | 15 | 0.2 | 60 | 570 | Good | ◎ | 115 | 511 | Example |
| 23 | 3 | Heating to 1,200° C. | 15 | 0.5 | 180 | 563 | Good | ◎ | 121 | 590 | Example |
| 24 | 4 | Heating to 1,200° C. | 20 | 1.3 | 180 | 552 | Good | ○ | 105 | 550 | Example |
| 25 | 5 | Direct rolling | 10 | 1.5 | 40 | 540 | Good | X | 125 | 440 | Comparative example |
| 26 | 6 | Direct rolling | 35 | 1.3 | 46 | 551 | Significant edge wave | ○ | 85 | 550 | Comparative example |
| 27 | 7 | Direct rolling | 10 | 1.3 | 40 | 551 | Good | X | 58 | 451 | Comparative example |
| 28 | 8 | Direct rolling | 10 | 1.2 | 35 | 521 | Good | X | 115 | 430 | Comparative example |
| 29 | 9 | Direct rolling | 15 | 1.5 | 45 | 540 | Good | X | 91 | 466 | Comparative example |
| 30 | 10 | Direct rolling | 15 | 1.5 | 41 | 532 | Good | X | 85 | 455 | Comparative example |
| 31 | 11 | Direct rolling | 15 | 1.5 | 35 | 510 | Good | X | 104 | 448 | Comparative example |
| 32 | 12 | Direct rolling | 15 | 1.5 | 40 | 516 | Good | X | 110 | 431 | Comparative example |

What is claimed is:

1. A high strength steel sheet consisting essentially of 0.04 to 0.1% C, 0.5% or less Si, 0.5 to 2% Mn, 0.05% or less P, 0.005% or less O 0.005% or less S, by weight, having 10 μm or less of average ferritic grain size, and 20 mm/mm$^2$ or less of generation frequency A, which generation frequency A is defined as the total length of a banded secondary phase structure observed per 1 mm$^2$ of steel sheet cross section along the rolling direction thereof.

2. The high strength steel sheet of claim 1 further containing 0.01 to 0.3% as the sum of at least one element selected from the group consisting of Ti, Nb, V, Mo, and Cr.

3. The high strength steel sheet of claim 1, wherein the variations of tensile strength in the width direction and in the longitudinal direction of the steel sheet is within ±8% to the average value thereof.

4. The high strength steel sheet of claim 2, wherein the variations of tensile strength in the width direction and in the longitudinal direction of the steel sheet is within ±8% to the average value thereof.

5. A method for manufacturing high strength steel sheet comprising the steps of:

hot-rolling a continuously cast slab having the composition described in claim 1 or claim 2 at temperatures of $Ar_3$ transformation point or above directly or after reheating thereof;

and cooling the hot-rolled steel sheet within 2 seconds down to the temperatures of from 600 to 750° C. at cooling speeds of from 200 to 2,000° C./sec, followed by coiling the cooled steel sheet at temperatures of from 450 to 650° C.

6. The method for manufacturing high strength steel sheet of claim 5 further comprising the step of either applying pickling and annealing to the coiled steel sheet or applying pickling and cold-rolling, followed by annealing thereto.

7. The method for manufacturing high strength steel sheet of claim 5, wherein a treatment for reducing segregation is applied during the continuous casting.

8. The method for manufacturing high strength steel sheet of claim 6, wherein a treatment for reducing segregation is applied during the continuous casting.

9. The method for manufacturing high strength steel sheet of claim 5, wherein, after cooling the steel sheet at cooling speeds of from 200 to 2,000° C./sec, the variations of temperature in the width direction and in the longitudinal direction of the steel sheet are controlled within 60° C.

10. The method for manufacturing high strength steel sheet of claim 6, wherein, after cooling the steel sheet at cooling speeds of from 200 to 2,000° C./sec, the variations of temperature in the width direction and in the longitudinal direction of the steel sheet are controlled within 60° C.

11. The method for manufacturing high strength steel sheet of claim 7, wherein, after cooling the steel sheet at cooling speeds of from 200 to 2,000° C./sec, the variations of temperature in the width direction and in the longitudinal direction of the steel sheet are controlled within 60° C.

12. The method for manufacturing high strength steel sheet of claim 8, wherein, after cooling the steel sheet at cooling speeds of from 200 to 2,000° C./sec, the variations of temperature in the width direction and in the longitudinal direction of the steel sheet are controlled within 602° C.

13. The method for manufacturing high strength steel sheet of claim 9, wherein the cooling is conducted at heat transfer coefficients of 2,000 kcal /$m^2$h° C. or more.

14. The method for manufacturing high strength steel sheet of claim 10, wherein the cooling is conducted at heat transfer coefficients of 2,000 kcal /$m^2$h° C. or more.

15. The method for manufacturing high strength steel sheet of claim 11, wherein the cooling is conducted at heat transfer coefficients of 2,000 kcal/$m^2$h° C. or more.

16. The method for manufacturing high strength steel sheet of claim 12, wherein the cooling is conducted at heat transfer coefficients of 2,000 kcal/$m^2$h° C. or more.

* * * * *